US005865564A

United States Patent [19]

Miller et al.

[11] Patent Number: 5,865,564

[45] Date of Patent: Feb. 2, 1999

[54] WATER-FILLABLE BARRIER

[75] Inventors: Darren Andrew Miller, Houston, Tex.; Donald L. Sullins, Allen Park, Mich.; Guy D. Sullins, South Lyon, Mich.; Thomas P. Stephenson, Carleton, Mich.

[73] Assignee: Aqua-Barrier, Inc., Houston, Tex.

[21] Appl. No.: 863,093

[22] Filed: May 23, 1997

[51] Int. Cl.[6] ..... E02B 7/20; E02B 7/50; E01F 7/00

[52] U.S. Cl. ..... 405/115; 405/16; 405/21; 405/52; 405/91; 405/114

[58] Field of Search ..... 405/16–21, 32, 405/52, 43, 45, 36, 114, 115, 91

[56] References Cited

U.S. PATENT DOCUMENTS

| | | | |
|---|---|---|---|
| 3,080,124 | 3/1963 | Rathmann | 405/45 X |
| 3,373,568 | 3/1968 | Hornbostel | 405/21 |
| 3,837,169 | 9/1974 | Lamberton | 405/19 X |
| 4,299,514 | 11/1981 | Muramatsu et al. | 405/115 |
| 4,692,060 | 9/1987 | Jackson, III | 405/115 |
| 4,799,821 | 1/1989 | Brodersen | 405/115 |
| 4,921,373 | 5/1990 | Coffey | 405/115 |
| 4,966,491 | 10/1990 | Sample | 405/21 X |
| 4,981,392 | 1/1991 | Taylor | 405/21 X |
| 5,040,919 | 8/1991 | Hendrix | 405/115 |
| 5,059,065 | 10/1991 | Doolaege | 405/115 |
| 5,125,767 | 6/1992 | Dooleage | 405/115 |
| 5,158,395 | 10/1992 | Holmberg | 405/15 X |
| 5,470,177 | 11/1995 | Hughes | 405/115 |

*Primary Examiner*—Dennis L. Taylor
*Attorney, Agent, or Firm*—Tim Headley; Haynes and Boone, L.L.P.

[57] ABSTRACT

A fluid-fillable barrier includes a tubular, impermeable membrane and at least one tension member. The membrane has a first attachment area and a second attachment area. The tension member secures between, and extends from, the first attachment area to the second attachment area. When in tension, the tension member may pivot with respect to the membrane, and has a taut length which is less than one-half of the perimeter of a cross section of the membrane, the length and perimeter being measured at a common cross-section taken perpendicular to a longitudinal axis of the membrane.

27 Claims, 8 Drawing Sheets

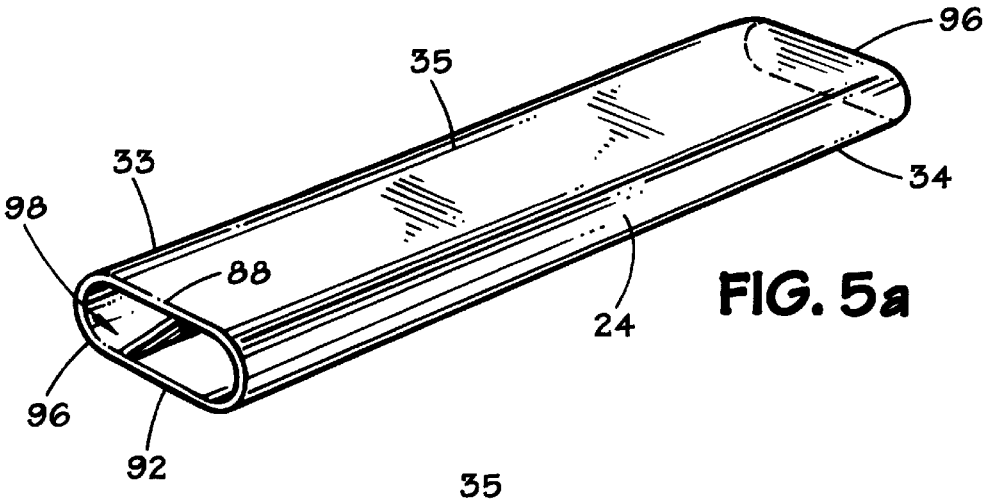
FIG. 5a
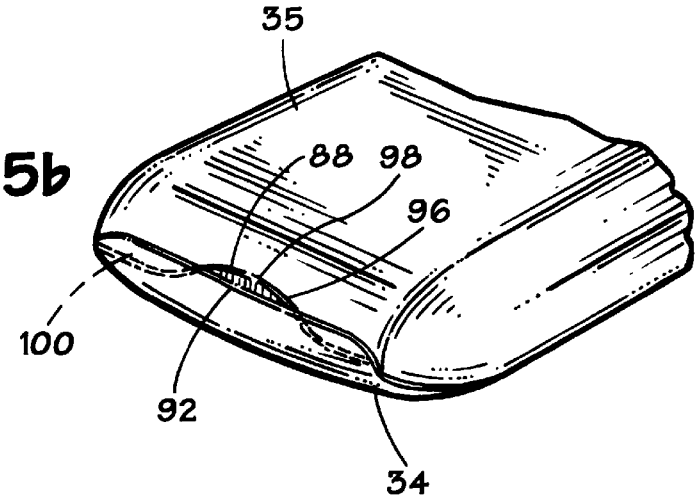
FIG. 5b
FIG. 6
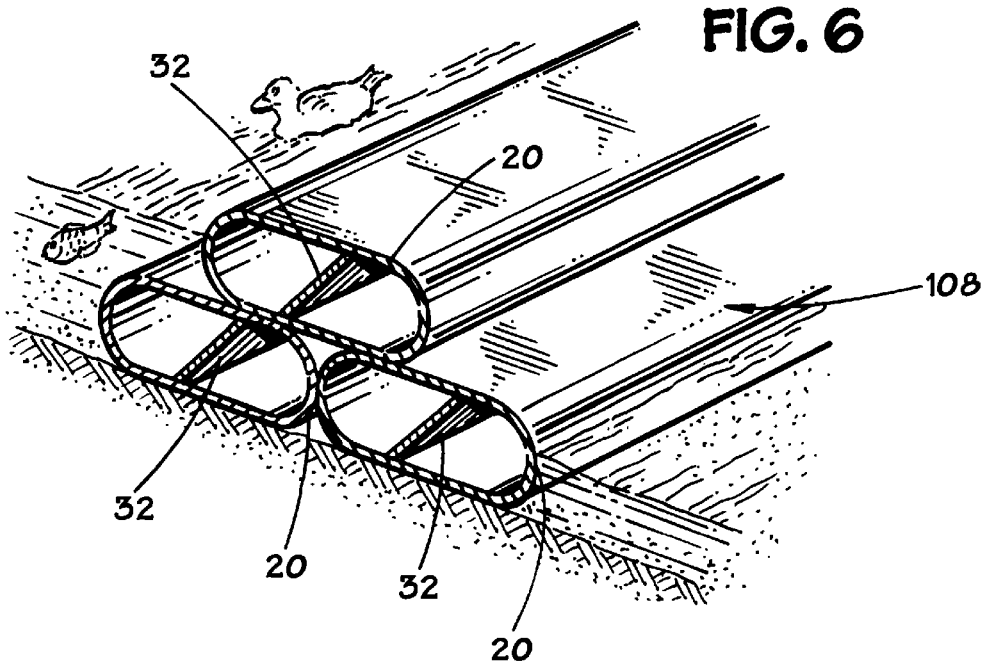

WATER-FILLABLE BARRIER

BACKGROUND OF THE INVENTION

This invention relates to barriers for damming water in order to facilitate bioremediation, flood control, or construction in a wet work area.

In preparation for the erection of a bridge abutment or a pipeline over a stream, it is necessary to dewater, divert, or otherwise control water flow in order to create a dry area into which workers may pour concrete. A prior art method of dewatering involves the steps of (1) driving sheet pilings into the ground in order to create an enclosed area, and (2) pumping unwanted water from the enclosed area. Each piling abuts an adjacent piling, thus sealing against water leakage between the pilings. However, installing sheet pilings is both labor and capital-equipment intensive. Further, such barriers are difficult to remove once in place.

In situations in which large areas must be dewatered, such as in the bioremediation of a swamp contaminated with styrenes or petroleum, or in flood control situations, the sheet piling method is impractical. Other methods have been developed, the simplest and most efficient of which include the use of water-filled barriers.

U.S. Pat. No. 5,125,767 (the '767 patent) to Dooleage discloses a pair of flexible, impermeable bags 11 and 12, held together in a side-by-side relationship by a surrounding cover 13, such as another bag. Col. 2, lines 33–36. Although simple in comparison to sheet piling methods, the cover 13 in the Dooleage design hides the inner bags 11 and 12. This makes it difficult to determine, prior to filling the bags, whether the bags 11 and 12 are properly aligned or whether they are tangled. In addition, utilizing three separate tubes increases the complexity and requires more material, thus increasing the weight of the design.

U.S. Pat. No. 5,059,065 (the '065 patent) to Dooleage discloses in FIG. 9 a water structure section 31 which connects at its end 31*a*, in abutting engagement, with another water structure section 30. One end of the connecting sleeve 21 receives the water structure section end 31*a*, with the other connecting sleeve end arranged beneath the water structure section 30. On filling of the water structures and connecting of the sleeve plugs, the connecting sleeve 21 locks in place under the water structure section 30. Col. 6, line 66 through Col. 7, line 8.

U.S. Pat. No. 4,799,821 to Brodersen discloses an elongated flexible tube 12, which fills with water, and "joint packing material 16" "such as dirt" (Col. 4, line 46), placed at the junction of the water-filled tube and the ground surface 18. Col. 3, lines 10–19. However, the necessity of using the dirt increases the time which erection of the dike structure requires. Further, without the dirt, the dike structure would apparently tend to roll in the direction of the applied water pressure.

U.S. Pat. No. 5,040,919 to Hendrix discloses a containment device which includes an elongated, flexible tube 11 in the shape of an oblique angled triangle. Col.2, lines 60–64. The triangular shape is maintained by gussets 14 of flexible material, attached by welding or adhesion to the inside of the tube 11. Arcuate cutouts 12 are placed at regular intervals along the inner circumference of the tube 11. Col. 2, lines 65 to Col. 3, line 5. However, the gussets 14 would apparently wrinkle when subjected to a transverse load. It would appear that wrinkling is minimized only when water completely fills the tube 11. Further, it appears that the walls of the tube 11 itself are fully placed in tension only when water completely fills the tube. Therefore, apparently, water must completely fill the tube 11 in order for the containment device to be fully effective.

What is needed is a fluid-fillable barrier which is simple, efficient, easily deployable and light weight, which provides a secure barrier at any filled height, and which does not require shoring up or bracing in order to prevent movement or leakage.

SUMMARY OF THE INVENTION

The present invention solves the foregoing problems and achieves technical advantages with a fluid-fillable barrier which includes a flexible tubular, impermeable membrane and at least one internal tension member. The membrane has opposite ends, a middle, fluid-fillable section, an upper attachment area, and a lower attachment area. The tension member secures between, and extends from, the upper attachment area to the lower attachment area. The tension member has a length which is less than one-half the perimeter of the membrane, the length and perimeter being measured at a common cross-section, taken perpendicular to a longitudinal axis of the membrane.

In another feature, the tension member is a flexible, planar material having opposite edges which include corresponding upper and lower bonding areas. The upper and lower bonding areas bond to corresponding upper and lower attachment areas on the barrier.

In another feature, the barrier includes fittings for filling the barrier with a fluid and for draining the fluid from the barrier. The fittings have wide flanges which abut against opposite sides of a wall of the membrane. Fasteners fasten between the flanges, thus clamping the flanges together and capturing the wall of the membrane. This evenly distributes the stresses in the wall, and seals the fitting against leakage.

In another feature, the tubular, membrane has opposite ends which a worker seals against fluid leakage in the following manner. Opposite sides of a perimetrical edge are brought together. The worker trims the edge to allow an overlap between opposite sides of the edge. The sides bond together at the overlap in a lap-seam.

In another feature, the barrier is part of a barrier assembly which includes at least one other barrier. The barrier assembly has at least two barriers which stack one upon another.

In another feature, the barrier bulges prior to delamination of the lap seams, thereby providing a visual warning of overfilling.

In another feature, a webbing connects adjacent barriers by strapping a webbing portion around the barriers, thus sealing against leakage between the barriers.

BRIEF DESCRIPTION OF THE DRAWINGS

FIG. 5*a* is an isometric view of the water-fillable barrier of FIG. 1.

FIG. 5*b* is a perspective view of an end of the water-fillable barrier of FIG. 1.

FIG. 6 is a cross-sectional view of a stack of the water-fillable barriers of FIG. 1.

DETAILED DESCRIPTION OF THE PREFERRED EMBODIMENT

Figure 1:
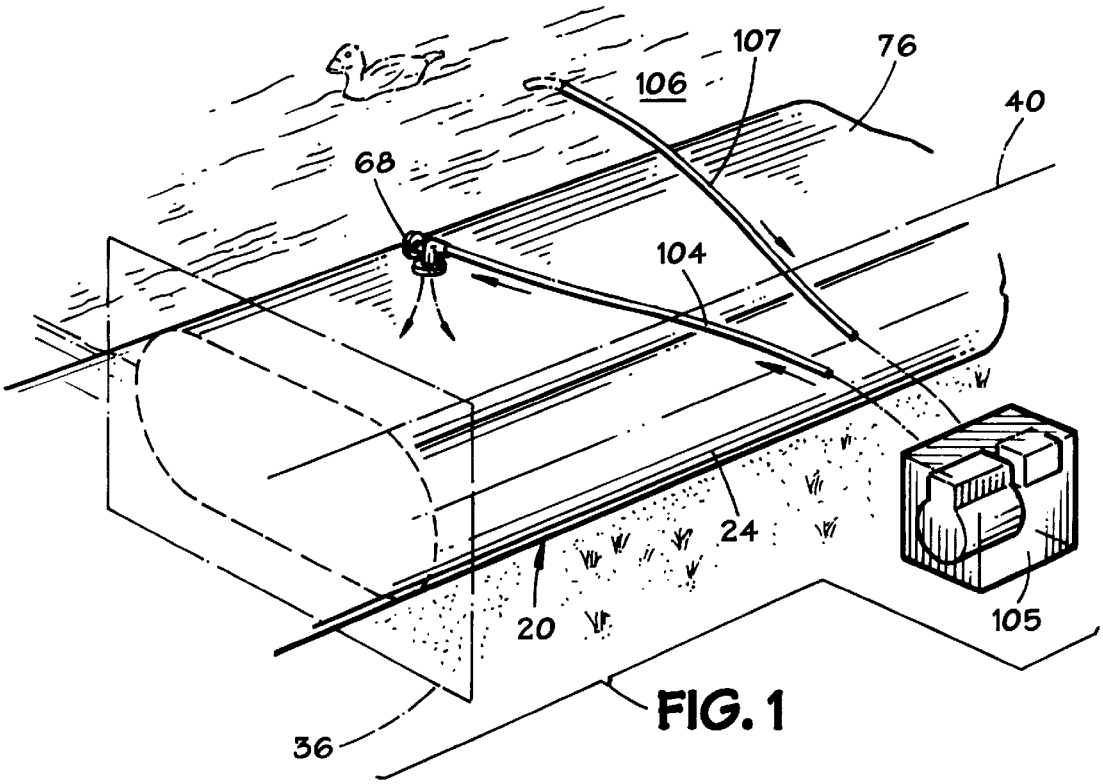
FIG. 1 is an isometric view of an illustrative water-fillable barrier.
Figure 2:
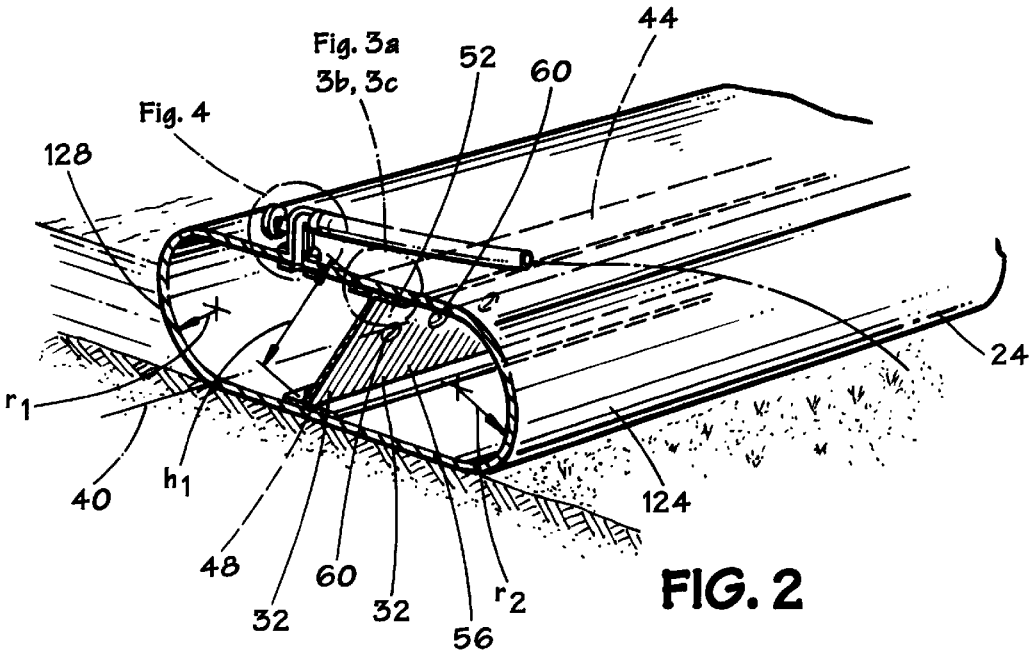
FIG. 2 is a isometric, cross-sectional view of the water-fillable barrier of FIG. 1, cut by the plane which reference numeral 36 in FIG. 1 indicates.

Referring to FIG. 1, a fluid-fillable barrier 20 includes a tubular, impermeable membrane 24 and a tension member 32 (shown in FIG. 2). The membrane 24 and the tension member 32 are fabricated from a 0.025 inch thick, flexible, woven polyester. A layer of flexible polyvinyl chloride coats the woven polyester. A cutting plane 36 indicates the location of the cross-section of FIG. 2. The cutting plane 36 is perpendicular to a central axis 40 of the membrane 24.

Referring now to FIG. 2, the membrane 24 has upper and lower attachment areas 44 and 48, which extend along a dimension parallel to the central axis 40 of the membrane 24. The tension member 32 is planar and has opposite ends 52 and 56 which include corresponding upper and lower bonding areas (e.g., 43, shown in FIG. 3*a*). The tension member 32 has openings 60 through which a fluid may pass, thus permitting the filling of the barrier 20 across the tension member. The tension member 32 has a maximum taut length h1 which is less than a laid-flat, empty width of the membrane 24, the length and the width being measured at a common cross-section. The cross-section is taken perpendicular to the central axis 40 of the membrane 24. The tension member 32 secures between, and extends from, the upper attachment area 44 to the lower attachment area 48. The upper and lower bonding areas bond to corresponding upper and lower attachment areas 44 and 48.

Figure 3A:
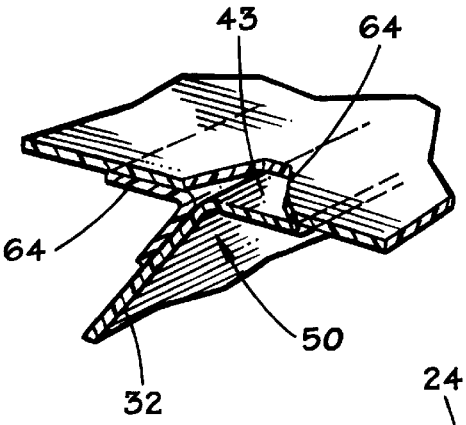
FIG. 3*a* is a partial cut-away, close up view of the region which reference numeral 3*a* in FIG. 1 indicates.

Referring now to FIGS. 2 and 3*a*, the bonding area 43 bonds to the corresponding attachment area 44 in a double lap-seam 50, along a bonding interface 64. The bonding is a thermal fusion bonding. Hot air welding fuses the bonding area 43 to the attachment area 44, thus creating bonding interfaces 64. During hot air welding, the bonding area 43 and the corresponding attachment area 44 pass between two rollers (not shown). Just prior to the bonding area 43 and the corresponding attachment area 44 entering between the rollers, a jet of hot air heats the bonding interface 64. This softens the bonding area 43 and the attachment area 44, in preparation for a bond.

Figure 4:
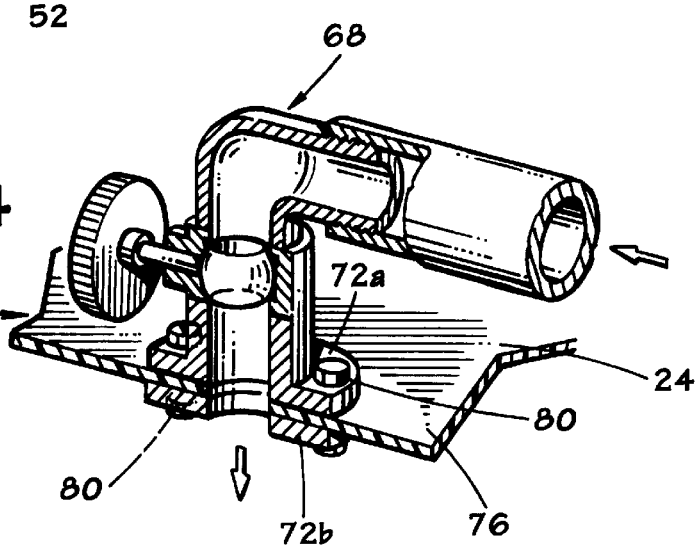
FIG. 4 is a close up, cross-sectional view of the region which reference numeral 4 in FIG. 1 indicates.

Referring now to FIG. 4, the barrier 20 includes fittings 68 for filling the barrier with a fluid and draining the fluid from the barrier. The fittings 68 have wide flanges 72*a* and 72*b*, which abut against opposite sides of a wall 76 of the membrane 24. Fasteners 80 fasten between the flanges 72*a* and 72*b*, thus clamping the flanges together and capturing the wall 76 of the membrane 24. This evenly distributes the stresses in the wall 76, and seals the fitting 68 against leakage.

Referring now to FIGS. 5*a* and 5*b*, the membrane 24 has opposite ends 33 and 34, each having a perimetrical edge 96 defining an opening 98. A worker seals the opposite ends 33 and 34 against fluid leakage in the following manner. Opposite sides 88 and 92 of a perimetrical edge 96 are brought together. The worker trims the edge 96 to allow an overlap 100 between opposite sides 88 and 92. The sides 88 and 92 bond together at the overlap 100 in a lap-seam.

Once the barrier 20 is manufactured, a worker stores the barrier 20 empty. The worker may either roll up or fan-fold the barrier 20 in preparation for storage, depending on the requirements of the anticipated use.

In operation, when deploying the barrier 20 from a stored configuration on dry land, the barrier 20 is advantageously stored in a rolled condition. This minimizes abrasion of the barrier 20 against the ground during deployment.

In a situation in which there is moving water across which the barrier 20 must span, and the barrier was stored in a rolled condition, a worker may concurrently unroll and fill the barrier, thus permitting the barrier to sink to the floor of the moving water. The weight of the filled portion of the barrier 20 helps anchor the barrier during deployment across the moving water, provided that the head of water in the barrier exceeds the head of the moving water, and the weight generates sufficient friction with the floor to resist the hydrodynamic pressure which the moving water imposes.

In a situation in which there is standing water across which the barrier 20 must span, a worker may pull the barrier, which a worker had stored in a fan-folded condition, across the water from an embankment 212 or 214 (shown in FIG. 12) opposite the deployment point. This enables rapid deployment of the barrier 20. The worker may then fill the barrier 20 after deployment.

Unless a worker fills the barrier 20 concurrently with water during deployment, or uses a barrier whose ends 33 or 34 (shown in FIG. 5*a*) are sealed, the worker must prepare the ends such that water will not leak out from the ends, according to the embodiments described above.

Referring again to FIGS. 1 and 2, after the ends 33 and 34 (shown in FIG. 5*a*) are sealed, the worker attaches a water fill line 104 from a pump 105 to the fitting 68. The worker attaches a suction line 107 from a water source into the barrier 20 to the pump 105. The worker then pumps water 106 from the water source into the barrier 20. When the wall 76 of the barrier 20 begins to bulge along the double lap seam 50 (shown in FIG. 3*b*), then the barrier is full. When a net pressure applies to the side 124 and/or 128, the barrier 20 begins to roll in the direction of the net pressure. The net pressure is the difference between the hydrodynamic and/or hydrostatic pressure which a water head applies to the sides 124 and 128. The tension member 32 locks the barrier 20 against continued rotation which the net pressure induces, regardless of the barrier's filled height, thus providing a secure barrier which does not require shoring up or bracing in order to prevent further movement, and which, after the locking, is effective as a barrier at any point of filling, up to the maximum filled height of the barrier. The barrier 20 locks because, as the membrane 24 fills with water, and the net pressure causes the barrier to roll, the tension member 32 ultimately extends to its maximum taut length h1. Because the tension member 32 can stretch no further, and because further stretching is necessary in order for the tension member to continue around end radii "r1" and "r2" of the membrane 24 without deforming the shape of the membrane (which itself is fully in tension), the barrier 20 stops rolling and locks in place.

Referring now to FIG. 6, the barrier 20 may be part of a barrier assembly 108 which includes at least one other barrier. The barrier assembly 108 may have two or more barriers 20 which stack one upon another, in a pyramid fashion. This enables the control or damming of heads of water which exceed the height of a single barrier 20.

Figure 3B:
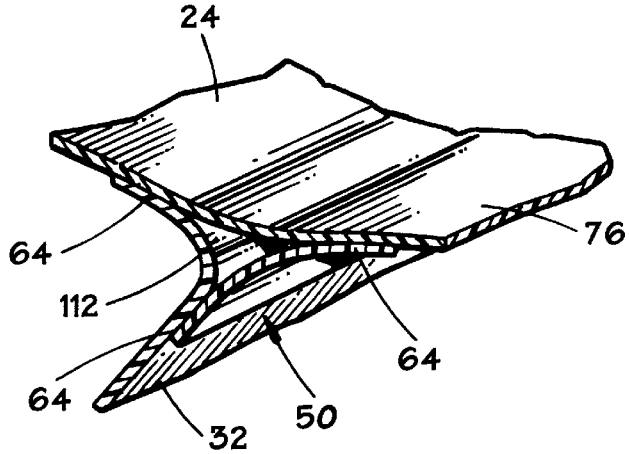
FIG. 3*b* is a close up view of another embodiment showing the region which reference numeral 3*b* in FIG. 1 indicates.

Referring now to FIG. 3*b*, in another embodiment, the double lap-seam 50 provides a substantially triangular gap 112 between the membrane 24 and the tension member 32.

Figure 3C:
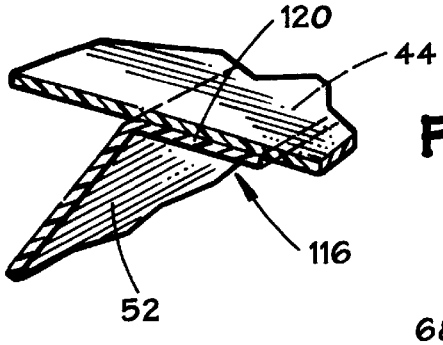
FIG. 3*c* is a close up view of another embodiment showing the region which reference numeral 3*c* in FIG. 1 indicates.

Referring now to FIGS. 2 and 3*c*, in another, simplified embodiment, two bonding areas, one along each end 52 and 56, and on opposite sides of the tension member 32, bond to corresponding attachment areas 44 and 48 in a single lap-seam 116 along a bonding interface 120. Bonding on opposite sides of the tension member 32 ensures that the bonding areas will not be subject to a high peeling force when a control fluid (the fluid which the barrier 20 shall control, contain, or divert) applies a net hydrodynamic and/or hydrostatic pressure to the side 128 of the barrier 20. However, in this embodiment, any net pressure which applies against the opposite side 124 would cause the barrier 20 to roll until the tension member locks the barrier against further motion. The tension in the tension member 32 would then apply a force to both lap-seams 116 which would tend to peel the lap-seams from their respective attachment areas 44 and 48, ultimately resulting in delamination and failure of the lap-seams. Therefore, although this embodiment is simple, it is effective only when the net pressure applies in a certain direction (in this case, side 128).

Figure 7:
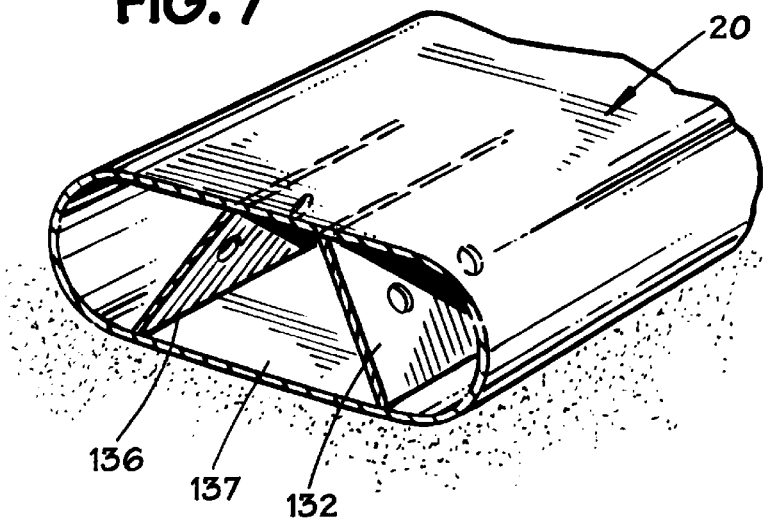
FIG. 7 is an isometric, cross-sectional view of another embodiment of the invention.

Referring now to FIG. 7, in another embodiment, the barrier 20 has at least two tension members 132 and 136 which lie in non-parallel planes. The tension member 132 inclines toward another tension member 136, thus forming a cell 137 between them which does not have the shape of a parallelogram. This arrangement minimizes the free lateral movement of the barrier 20, prior to the barrier locking in place.

In another embodiment (not shown), the tension members 132 and 136 may lie in parallel planes.

Figure 8:
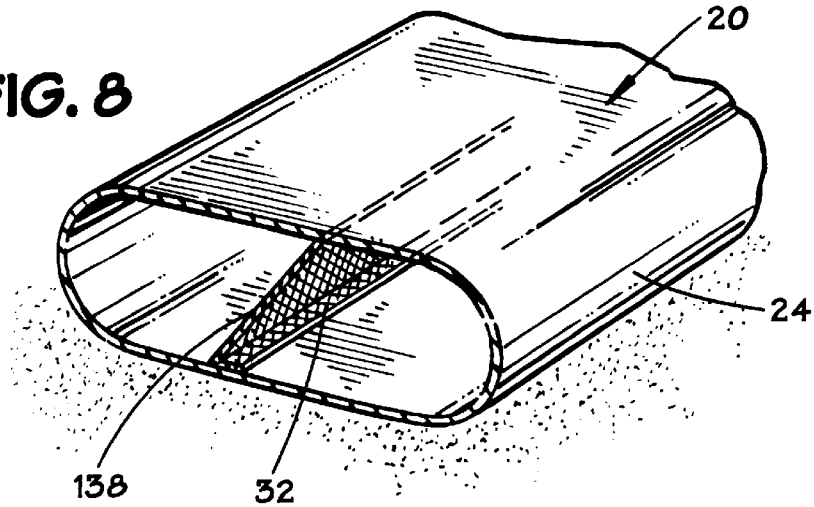
FIG. 8 is an isometric, cross-sectional view of another embodiment of the invention.

Referring now to FIG. 8, in another embodiment, the tension member 32 is a netting material 138.

Figure 9:
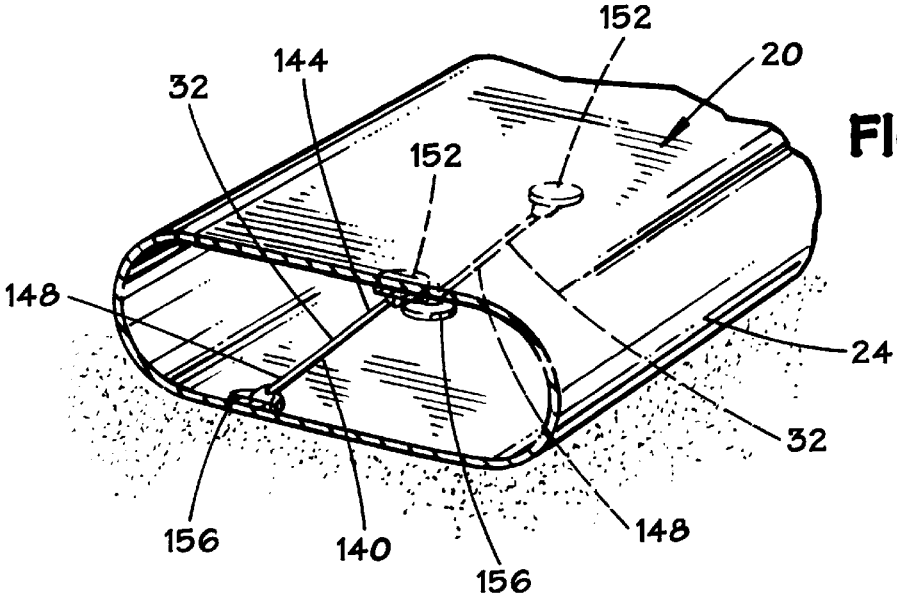
FIG. 9 is an isometric, cross-sectional view of another embodiment of the invention.

Referring now to FIG. 9, in another embodiment, the tension member 32 is a strap or a cable 140. The strap 140 has upper and lower ends 144 and 148, which bond or otherwise attach to corresponding attachment areas 152 and 156 of the membrane 24.

Figure 10:
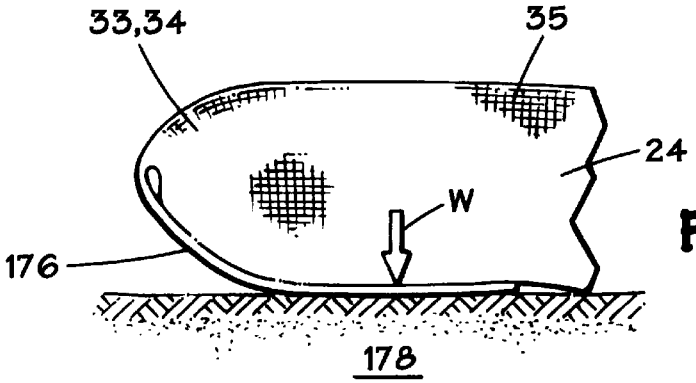
FIG. 10 is a partial side view of another embodiment of an end of the invention.

Referring now to FIGS. 5*a* and 10, in another embodiment, a worker seals the opposite ends 33 and 34 against fluid leakage by bringing opposite sides 88 and 92 of each edge 96 together, and folding a length of each end underneath the middle, fluid-fillable section 35. This defines a folded over portion 176. The worker then fills the barrier 20 with a fluid such that the weight of the fluid, indicated by the arrow, "w", against the folded over portion 176 and the ground 178, seals each end 33 and 34.

Figure 11:
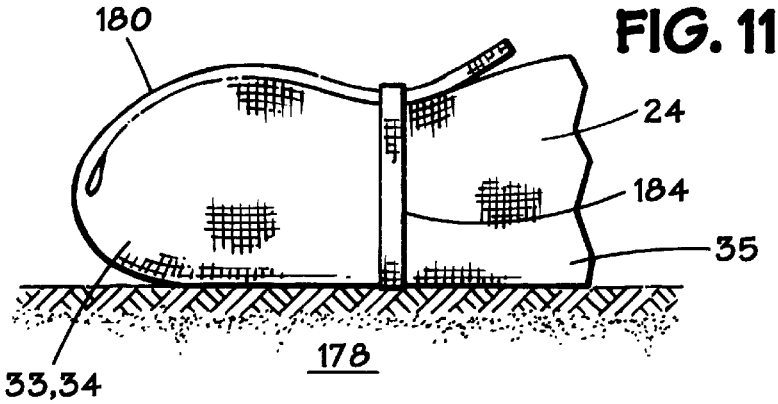
FIG. 11 is a partial side view of another embodiment of an end of the invention.

Referring now to FIGS. 5*a* and 11, in another embodiment, the ends 33 and 34 seal against fluid leakage by closing each edge 96 of the membrane 24, folding over a length of each end back over the middle, fluid-fillable section 35, thus defining a folded over portion 180, tucking a length of the folded over portion under a closed strap 184 having a predetermined perimetrical length, and filling the barrier 20 with a fluid such that the strap applies pressure against the folded over portion, thus sealing the end.

Figure 12:
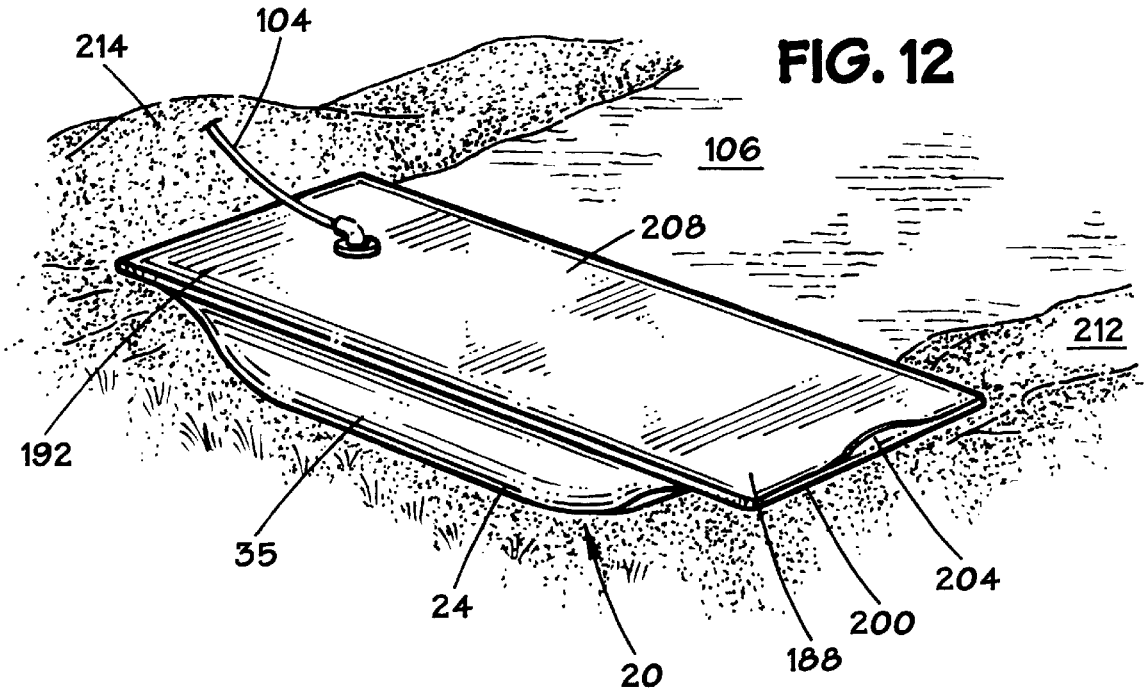
FIG. 12 is a perspective view of another embodiment of the invention.

Referring now to FIG. 12, in another embodiment, the membrane 24 has opposite ends 188 and 192, and a middle, fluid-fillable section 35. The opposite ends 188 and 192 each have a perimetrical edge 200 defining an opening 204. A worker elevates the opening 204 to a height which is higher than a height which the fluid-fillable section 35 attains when filled with fluid, thus preventing fluid leakage from the elevated end 188 or 192. Embankments 212 and 214, for example, may conveniently serve to elevate the ends 188 and 192.

Figure 13:
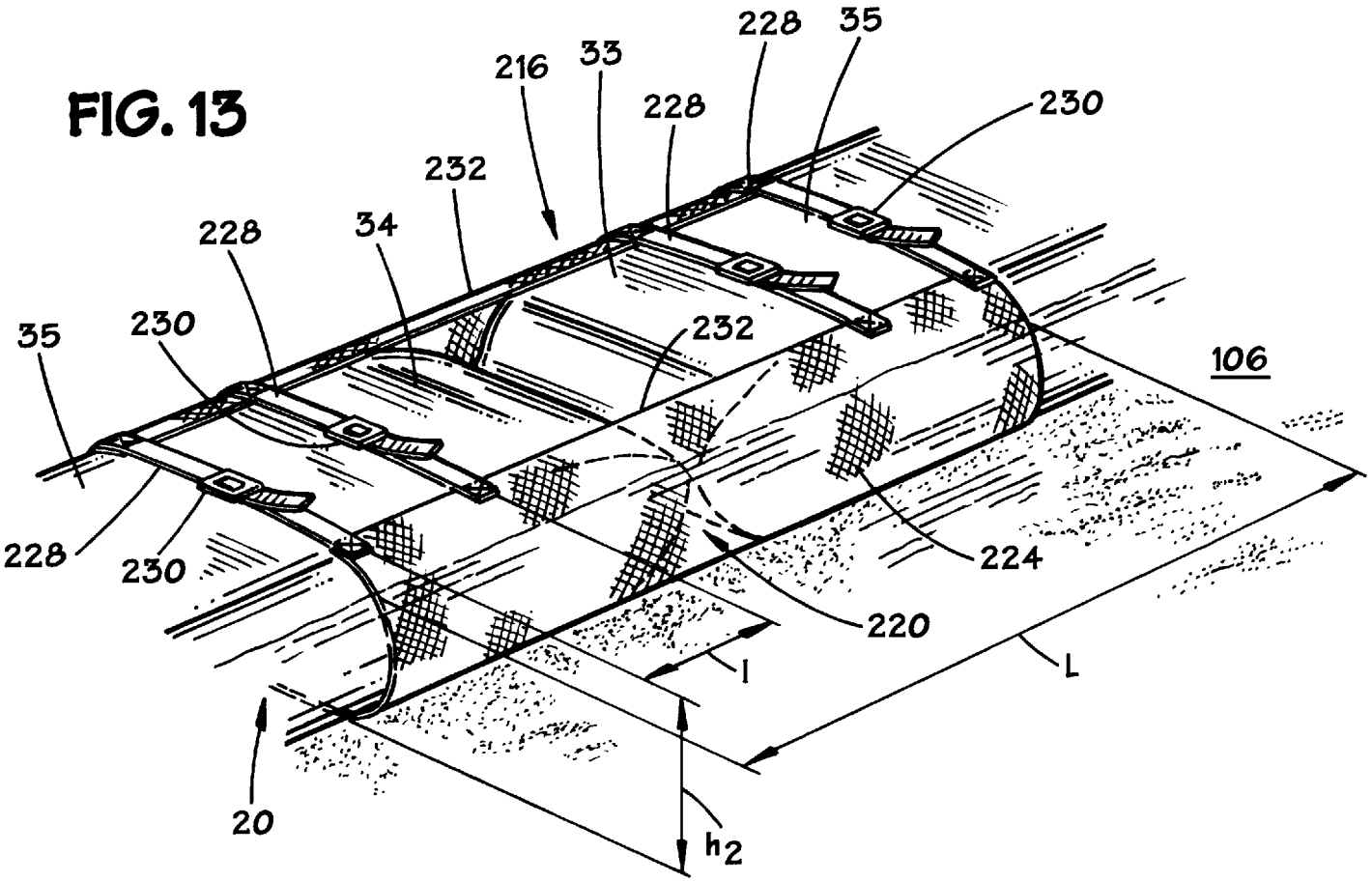
FIG. 13 is a perspective view of an end-to-end assembly of the invention.

Referring now to FIG. 13, in another embodiment, the barrier 20 is part of a barrier assembly 216 in which a webbing 220 joins at least two barriers end-to-end. The webbing 220 is tailored to join the barriers 20 at a 180° angle, although the webbing may optionally be tailored to join the barriers 20 at any angle. The webbing 220 straps around the adjacent ends 33 and 34 of the barriers 20. The webbing 220 includes a webbing portion 224 and straps 228 with adjustable connectors or buckles 230. The webbing portion 224 has a length, "L", sufficient to overlap an area of the middle, fluid-fillable section 35 near each of the adjacent ends 33 and 34. The overlap has a length, "l", sufficient to seal against fluid pressure, and a width sufficient to wrap around each adjacent barrier 20 to a height, "h2", which is higher than an anticipated depth of the water 106 to be controlled, contained, or diverted. This prevents excessive flow of fluid past the webbing portion 224. The straps 228 connect to an edge 232 of the webbing portion 224. The adjustable buckles 230 adjustably connect corresponding straps 228 together around the barriers 20. The straps 228 draw tightly around each barrier 20, thus sealing the webbing 220 against the barriers 20.

Figure 14:
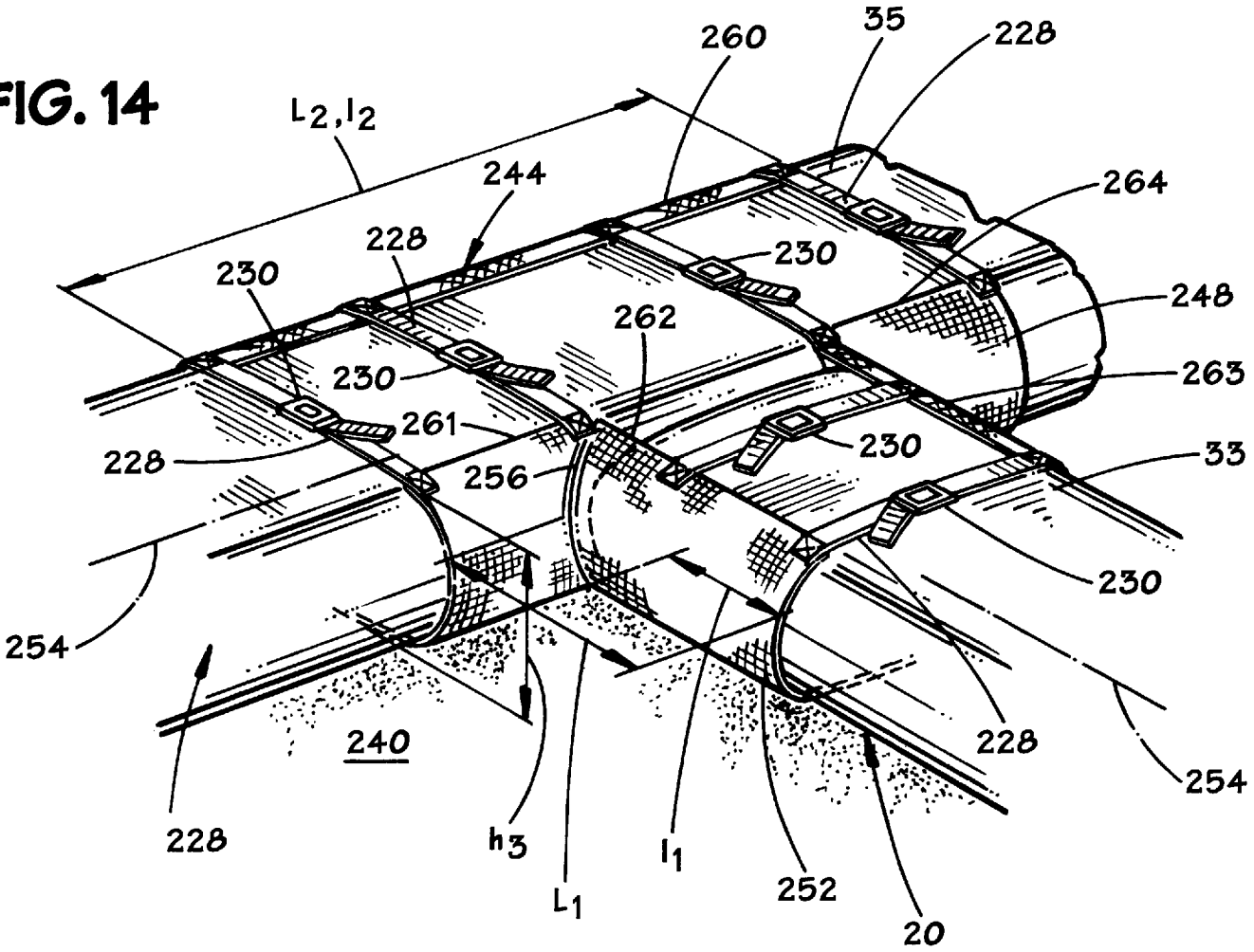
FIG. 14 is a perspective view of a "T" joint assembly of the invention.

Now referring to FIG. 14, in another embodiment, the barrier 20 is part of a barrier assembly 240 in which a webbing 244 joins two barriers, one barrier being joined by its end 33, and the other along its middle, fluid-fillable section 35. The webbing 244 includes two webbing portions 248 and 252, and straps 228 with adjustable buckles 230. The webbing portions 248 and 252 are each tailored to cradle one of the adjacent barriers 20, wrapping around the middle, fluid-fillable section 35 of one of the barriers and an end 33 of another barrier, including a portion of the fluid-fillable section 35 of this barrier, in a "T" joint. Nevertheless, the webbing 244 may optionally be tailored to join the barriers 20 at a wide range of angles. The webbing portions 248 and 252 have lengths, "L1" and "L2", defined parallel to an axis 254 of the barrier 20 around which each wraps, sufficient to overlap an area of the middle, fluid-fillable section 35 of each of the adjacent barriers. The overlap has a length, "l1" and "l2", sufficient to seal against excessive fluid flow, and a width sufficient to wrap around each adjacent barrier 20 to a height, "h3", which is higher than the anticipated depth of water to be controlled, contained, or diverted. This prevents excessive flow of fluid past the webbing 244. The webbing portions 248 and 252 connect together at a seam 256 to form the unbroken, sealed webbing 244 between adjacent barriers 20. The straps 228 connect to edges 260, 261, 262, 263, and 264 of the webbing portions 248 and 252. The adjustable buckles 230 adjustably connect corresponding straps 228 together around the barriers 20.

The straps 228 draw tightly around each barrier 20, thus sealing the webbing 244 against the barriers.

Figure 15:
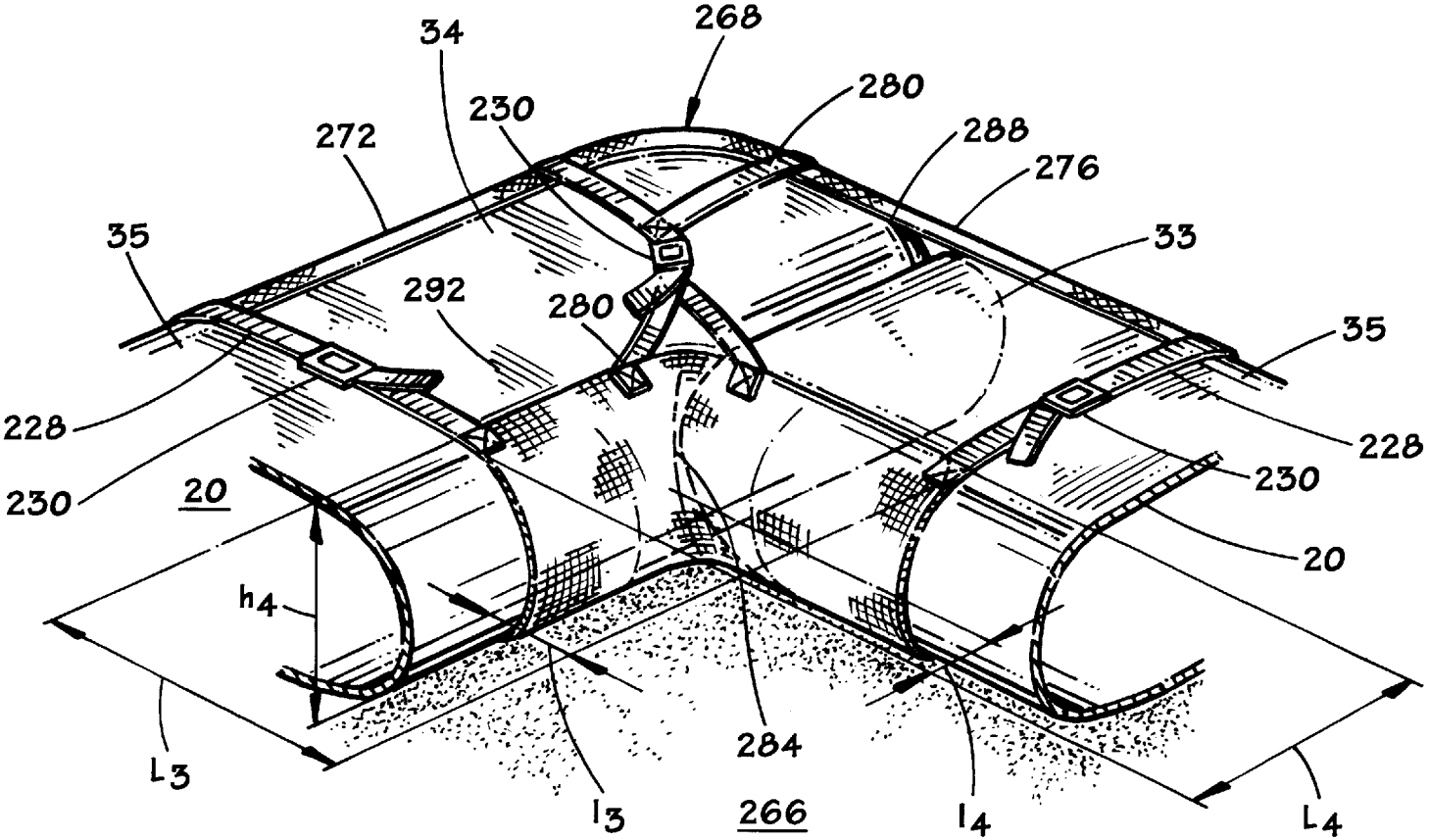
FIG. 15 is a perspective view of a "L" joint assembly of the invention.

Now referring to FIG. 15, in another embodiment, the barrier 20 is part of a barrier assembly 266 in which a webbing 268 joins the ends 33 and 34 of two barriers. The webbing 268 includes two webbing portions 272 and 276, and straps 228 and 280 with adjustable buckles 230. The webbing portions 272 and 276 are each tailored to cradle the ends 33 and 34 of the adjacent barriers 20, wrapping around a portion of the middle, fluid-fillable sections 35 of each of the barriers, in a "L" joint. Nevertheless, the webbing may optionally be tailored to join the barriers 20 at a wide range of angles. The webbing portions 272 and 276 have lengths, "L3" and "L4", defined parallel to an axis of the barrier 20 around which each wraps, sufficient to overlap a portion of the middle fluid-fillable section 35 of each of the adjacent barriers. The overlap has a length, "l3" and "l4", sufficient to seal against excessive fluid flow, and a width sufficient to wrap around each adjacent barrier 20 to a height, "h4", which is higher than the anticipated depth of water to be controlled, contained, or diverted. This prevents excessive flow of fluid past the webbing 268. The webbing portions 272 and 276 connect together along a seam 284 to form an unbroken, sealed webbing 268 between adjacent barriers 20. The straps 228 and 280 connect to edges 288 and 292 of each webbing portion 272 and 276. The adjustable buckles 230 adjustably connect corresponding straps 228 and 280 together around the barriers 20. The straps 228 and 280 draw tightly around each barrier 20, thus sealing the webbing 268 against the barriers.

A technical advantage of the invention is that it is simple and economical.

Another technical advantage is that, after locking, the invention provides a secure barrier 20 over a wide range of heights, from a few inches to the maximum filled height of the barrier.

Another technical advantage is that the invention is easily deployable and light weight. A six foot high by 100 foot long barrier weighs only about 550–600 lbs empty.

Another technical advantage is that the tension members 32, 132, and 136 lock the barrier 20 against continued rotation induced by unequal hydrostatic and/or hydrodynamic pressure applied against sides 124 or 128 (shown in FIG. 2) of the barrier, thus providing a secure barrier which does not require shoring up or bracing in order to prevent movement.

Another technical advantage, as shown in FIG. 3*b*, is that the wall 76 of the barrier 20 bulges prior to delamination of the lap seams, thereby providing a visual warning of overfilling.

Another technical advantage is that the bonding uses a double lap seam 50 which resists peeling, thus increasing the durability of the barrier.

Although an illustrative embodiment of the invention has been shown and described, other modifications, changes, and substitutions are intended in the foregoing disclosure. For example, the membrane 24 and/or the tension member 32 may be fabricated from other materials, such as vinyl plastic, nylon-reinforced or polyester-reinforced neoprene rubber, polyethylene, polypropylene, butyl rubber, or other reinforced plastic or rubber. In addition, the opposite ends 33 or 34 of the barrier 20 may seal in differing manners, one end sealing according to one of the embodiments described above, and the other end according to another. Further, other connectors, such as mating "VELCRO" straps, D-rings, clamps, or a hand-crankable draw mechanism, may substitute for the buckles 230. Accordingly, it is appropriate that the appended claims be construed broadly and consistent with the scope of the invention.

What is claimed is:

1. A fluid-fillable barrier comprising:

a. a tubular impermeable membrane having a longitudinal axis, opposite ends at first and second ends of the longitudinal axis, a middle, fluid-fillable portion, a first attachment area on a first side of the longitudinal axis, and a second attachment area on a second side of the longitudinal axis, the second side opposing the first side; and b. a tension member extending from the first attachment area to the second attachment area, the tension member having at least one hole to equalize fluid pressure on either side of the tension member, wherein, when the barrier is filled with fluid, and is in a place to block a fluid, the tension member prevents the barrier from being moved from the place by external fluid pressure, and wherein the tension member has a taut length which is less than one-half of the taut perimeter of a cross-section of the tubular membrane, the taut length and the taut perimeter being measured at a common cross-section taken perpendicular to a longitudinal axis of the tubular membrane.

2. The fluid-fillable barrier of claim 1 having at least two tension members, wherein at least two tension members are not parallel to one another.

3. The fluid-fillable barrier of claim 2, wherein the tension members lie in parallel planes.

4. The fluid-fillable barrier of claim 1, wherein the tension member is a strap.

5. The fluid-fillable barrier of claim 1, wherein the tension member is a planar membrane which is parallel to a longitudinal axis of the tubular impermeable membrane.

6. The fluid-fillable barrier of claim 1, wherein the tension member is a netting material.

7. The fluid-fillable barrier of claim 1, wherein the membrane and tension member are fabricated from a woven polyester which is coated with flexible polyvinyl chloride.

8. The fluid-fillable barrier of claim 5, wherein the tension member is a flexible, planar material having first and second opposite edges which include corresponding first and second bonding areas, the first and second bonding areas bonding to corresponding first and second attachment areas.

9. The fluid-fillable barrier of claim 8, wherein the bonding areas bond to corresponding attachment areas in a single lap-seam along a bonding interface.

10. The fluid-fillable barrier of claim 9, wherein the bonding areas are on opposite sides of the tension member.

11. The fluid-fillable barrier of claim 8, wherein the bonding areas bond to corresponding attachment areas in a double lap-seam.

12. The fluid-fillable barrier of claim 8, wherein the first and second attachment areas are elongated along a dimension parallel to the central axis of the membrane.

13. The fluid-fillable barrier of claim 11, wherein the double lap-seam provides a triangular gap between the membrane and the tension member.

14. The fluid-fillable barrier of claim 1 including fittings used for filling the barrier with a fluid and for draining the fluid from the barrier.

15. The fluid-fillable barrier of claim 14, wherein the fittings have wide flanges which abut against opposite sides of a wall of the membrane, between which fasteners fasten, thus clamping the flanges together, capturing the wall of the membrane, evenly distributing the stresses in the wall, and sealing the fitting against leakage.

16. The fluid-fillable barrier of claim 1, wherein the opposite ends seal against fluid leakage by bringing opposite sides of a perimetrical edge of the tubular membrane together, trimming the edge to allow an overlap between opposite sides of the edge, and bonding the sides together at the overlap in a lap-seam.

17. The fluid-fillable barrier of claim 16, wherein the bonding is a thermal fusion bonding.

18. The fluid-fillable barrier of claim 1, wherein the opposite ends each have a perimetrical edge which defines an opening, at least one of the opposite ends sealing against fluid leakage by bringing opposite sides of an edge together, folding over a length of each end underneath the tubular membrane thus defining a folded over portion, and filling the barrier with a fluid such that the weight of the fluid against the folded over portion seals the end.

19. The fluid-fillable barrier of claim 1, wherein the opposite ends each have a perimetrical edge which defines an opening, at least one of the opposite ends sealing against fluid leakage by closing the edge of the tubular membrane, folding over a length of the end back over the tubular membrane thus defining a folded over portion, tucking the length under a strap, and filling the barrier with a fluid such that the strap applies pressure against the folded over portion, thus sealing the end.

20. The fluid-fillable barrier of claim 1, wherein at least one of the opposite ends has a perimetrical edge defining an opening, the opening having an elevation higher than a height which the fluid-fillable portion attains when filled with fluid, thus preventing fluid leakage from the elevated end.

21. The fluid-fillable barrier of claim 1, wherein the barrier is part of a barrier assembly which includes at least one other barrier, the barrier assembly having at least two barriers which stack one upon another.

22. The fluid-fillable barrier of claim 1, wherein the barrier is part of a barrier assembly in which a webbing joins at least two barriers end-to-end by strapping around the adjacent ends of the barriers, the webbing comprising:

a) a webbing portion having a length sufficient to overlap an area of the middle, fluid-fillable portion, the area being adjacent each end, and a width sufficient to wrap around the barrier to a height sufficient to prevent the flow of fluid past the webbing portion;

b) straps which connect to an edge of the webbing portion; and c) connectors which adjustably connect corresponding straps together in a manner which seals the webbing against the barriers.

23. The fluid-fillable barrier of claim 22, wherein the barriers join at an angle, and the webbing is tailored to join the barriers at the same angle.

24. The fluid-fillable barrier of claim 1, wherein the barrier is part of a barrier assembly in which a webbing joints at least two barriers by strapping around the barriers, at least one barrier being joined by its end, the webbing comprising:

a) a webbing portion having a length sufficient to overlap an area of the middle, fluid-fillable portion, the area being adjacent each end, and a width sufficient to wrap around the barrier to a height sufficient to prevent the flow of fluid past the webbing portion;

b) straps which connect to an edge of the webbing portion; and c) connectors which adjustably connect corresponding straps together in a manner which seals the webbing against the barriers.

25. The barrier of claim 1, wherein when the barrier is filled with fluid, the first attachment area is on a top surface of the tubular membrane, and the second attachment area is on a bottom surface of the tubular membrane.

26. A fluid-fillable barrier comprising:

a. a tubular impermeable membrane having a longitudinal axis, opposite ends at first and second ends of the longitudinal axis, a middle, fluid-fillable portion, a first attachment area on a first side of the longitudinal axis, and a second attachment area on a second side of the longitudinal axis, the second side opposing the first side;

b. a tension member extending from the first attachment area to the second attachment area; and c. means for filling the barrier across the tension member, wherein, when the barrier is filled with fluid, the tension member prevents the barrier from being moved by external fluid pressure, and wherein the tension member has a taut length which is less than one-half of the taut perimeter of a cross-section of the tubular membrane, the taut length and the taut perimeter being measured at a common cross-section taken perpendicular to a longitudinal axis of the tubular membrane.

27. A fluid-fillable barrier comprising:

a. a tubular impermeable membrane having a longitudinal axis, opposite ends at first and second ends of the longitudinal axis, a middle, fluid-fillable portion, a first attachment area on a first side of the longitudinal axis, and a second attachment area on a second side of the longitudinal axis, the second side opposing the first side;

b. a tension member extending from the first attachment area to the second attachment area; and c. a filling fitting on either side of the tension member, wherein, when the barrier is filled with fluid, the tension member prevents the barrier from being moved by external fluid pressure, and wherein the tension member has a taut length which is less than one-half of the taut perimeter of a cross-section of the tubular membrane, the taut length and the taut perimeter being measured at a common cross-section taken perpendicular to a longitudinal axis of the tubular membrane.

* * * * *